United States Patent [19]

Richmond, Jr.

[11] 3,987,943

[45] Oct. 26, 1976

[54] DETACHABLE POURING FUNNEL FOR CONTAINERS

[75] Inventor: Roy H. Richmond, Jr., Wellsburg, W. Va.

[73] Assignee: Eagle Manufacturing Company, Wellsburg, W. Va.

[22] Filed: Apr. 11, 1975

[21] Appl. No.: 567,417

[52] U.S. Cl. ..... 222/570; 141/332

[51] Int. Cl.[2] ..... B65D 25/48; B67C 11/00

[58] Field of Search.... 141/286, 392, 106, 199–205, 141/297–300, 331–345, 363–366, 391, 98; 222/566–574

[56] References Cited

UNITED STATES PATENTS

| | | | |
|---|---|---|---|
| 2,471,189 | 5/1949 | Bartels | 222/570 |
| 2,628,736 | 2/1953 | Warneke | 222/570 |
| 3,120,911 | 2/1964 | Coultman et al. | 222/570 |
| 3,276,699 | 10/1966 | Graveley | 222/570 |

*Primary Examiner*—Houston S. Bell, Jr.

*Attorney, Agent, or Firm*—Parmelee, Miller, Welsh & Kratz

[57] ABSTRACT

A detachable pouring funnel for use with a container and in particular, a dome-top container having an upwardly extending spout is disclosed. The funnel comprises a collar portion provided with an inwardly directed annular flange, which flange engages an annular groove formed in the container spout whereby the funnel may be detachably received on the spout. The body of the funnel is of a generally frusto-conical configuration and is formed integrally with the collar portion, the axis of the body portion extending laterally of the axis of the collar portion.

8 Claims, 4 Drawing Figures

DETACHABLE POURING FUNNEL FOR CONTAINERS

BACKGROUND OF THE INVENTION

Portable liquid storage containers, such as gasoline storage containers or the like, are usually provided with upwardly extending spouts, the spout being closed by a lid or cap which is usually screwed onto threads provided on the spout. However, the container spouts are all too frequently too short to permit transfer of, for example, gasoline, from the storage container to, for example, an automobile gasoline tank, without excessive spillage and the concomitant hazards associated therewith. Additionally, the container spouts are generally of too large a diameter to permit, without excessive spillage, transfer of gasoline from the storage container to a smaller receptacle, such as, for example, an outboard motor or a power lawn mower gasoline tank.

Although conventional conical funnels may be used to facilitate liquid transfer, they are, as a practical matter, useful only in instances where liquid is transferred in a substantially vertical plane and are virtually useless in, for example, transferring gasoline from a storage container to a typical automobile gasoline tank. Moreover, as such funnels are separate from the storage container, they often become misplaced and often cannot be located at the time when they are most needed.

It is, therefore, desirable to provide a pouring funnel for use with liquid storage containers having upstanding spouts, which funnels may be readily, detachably engaged with the container spout and which also does not interfere with removal and replacement of the container spout lid or cap while the funnel is in place. One such detachable pouring funnel is described in Martinsen, U.S. Pat. No. 2,580,811. The Martinsen funnel comprises a generally frusto-conical body, the body being secured to the container spout by a resilient spring element. This construction is designed and claimed for use with flat top containers and would not be efficiently usable with a dome-top container.

SUMMARY OF THE INVENTION

A detachable pouring funnel for use with a container, and in particular a dome-top container having an upstanding spout is provided, the funnel comprising a cylindrical collar portion adapted to be snugly and releasably received on the upstanding container spout, the upper edge of the collar portion formed as an inwardly directed annular flange, the flange engaging an annular groove formed in the container spout and a funnel body integrally formed with the collar portion, the funnel body having a generally frusto-conical configuration. The axis of the funnel body extends laterally to the axis of the collar portion, the funnel being open at both ends and tapering from a wide rear opening proximate the collar portion to a narrow outlet opening, the lower surface of the body tapering forwardly and upwardly from the collar portion to the outlet end of the funnel. The outlet end of the funnel body has a step formed in the lower surface thereof, thereby defining a generally semi-cylindrical shaped outlet opening while the wide rear opening has a generally semi-cylindrical shape and is sized so as to permit substantially unobstructed manual access to the container spout to permit removal or replacement of the container spout lid or cap while the funnel is in place.

DETAILED DESCRIPTION OF THE INVENTION

Figure 3:
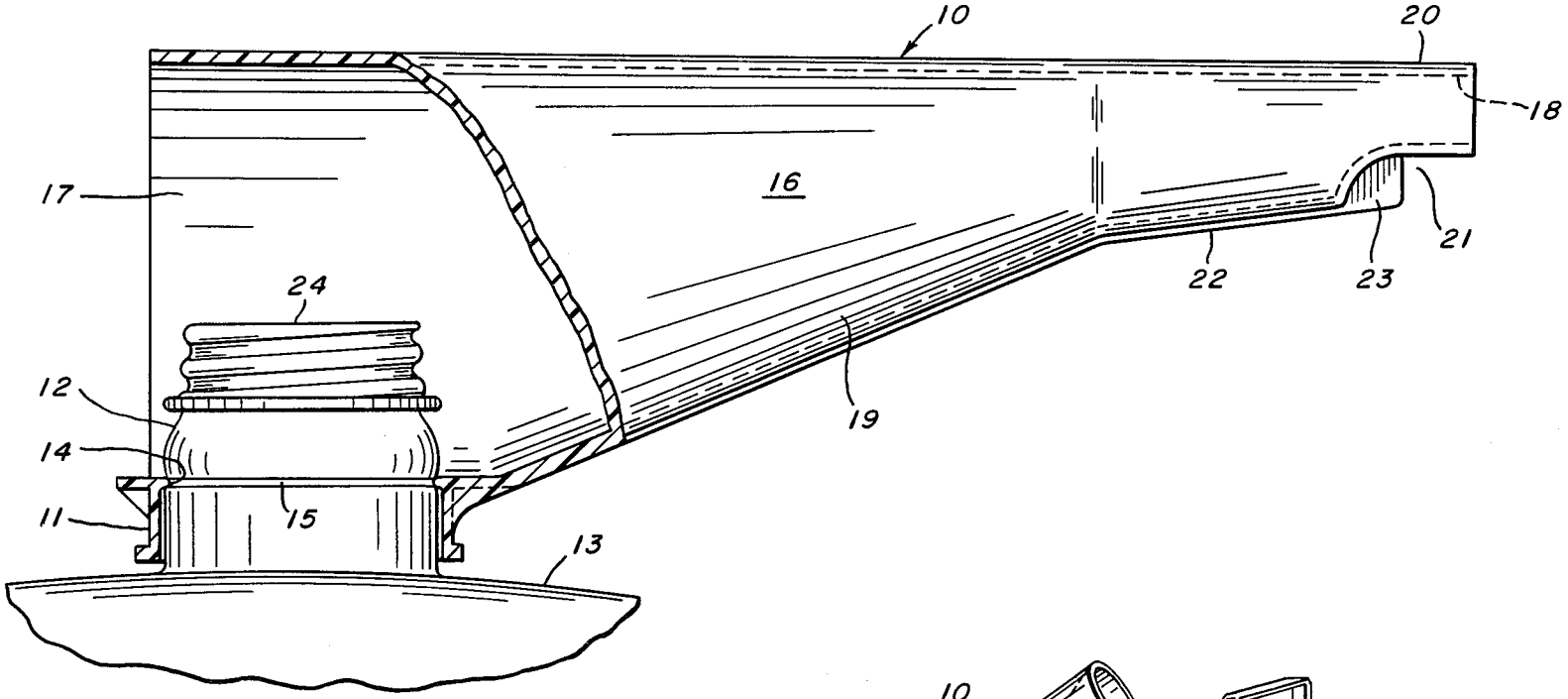
FIG. 3 is a side view of the pouring funnel of the invention, partly in section, showing the means by which the funnel is engaged with the upstanding spout of a dome type liquid storage container.
Figure 4:
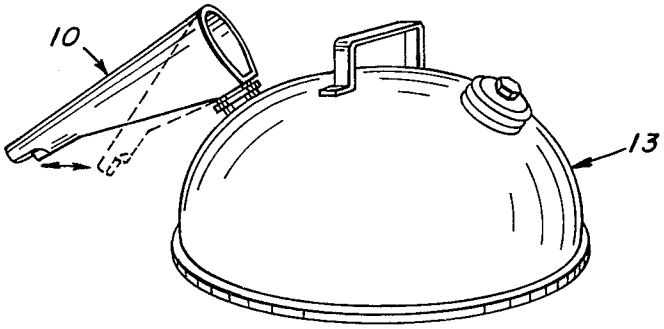
FIG. 4 is a perspective view of the pouring funnel of the invention mounted on a typical dome type liquid storage container.

With reference to the drawings wherein like elements are indicated throughout by like reference numerals, the pouring funnel of the invention is generally depicted at 10. The funnel 10 includes a cylindrical collar portion 11 sized so as to be snugly and detachably mounted on a spout 12 of a dome top storage container 13. The container 13, as shown more completely in FIG. 4, is of well-known, commercially available construction and is typically used for storing volatile liquids, such as gasoline or the like. As shown in FIG. 3, the upper edge of collar portion 11 is formed as an inwardly directed annular flange 14 which, when the collar 11 is press-fitted over the spout 12, engages an annular groove 15 formed in spout 12. Engagement of the flange 14 with groove 15 serves to retain the funnel in place on the spout 12 and also serves as a seal to prevent liquid which might dribble from the spout from running down the container sides.

A funnel body 16 is affixed to collar portion 11 and preferably the funnel body 16 and collar portion 11 are integrally formed and molded from a plastic material, such as, for example, a high density polyethylene or the like. Funnel body 16 is in open communication with collar portion 11, the body 16 having a generally frusto-conical configuration, the axis of body portion 16 extending laterally of the axis of collar portion 11.

Figure 1:
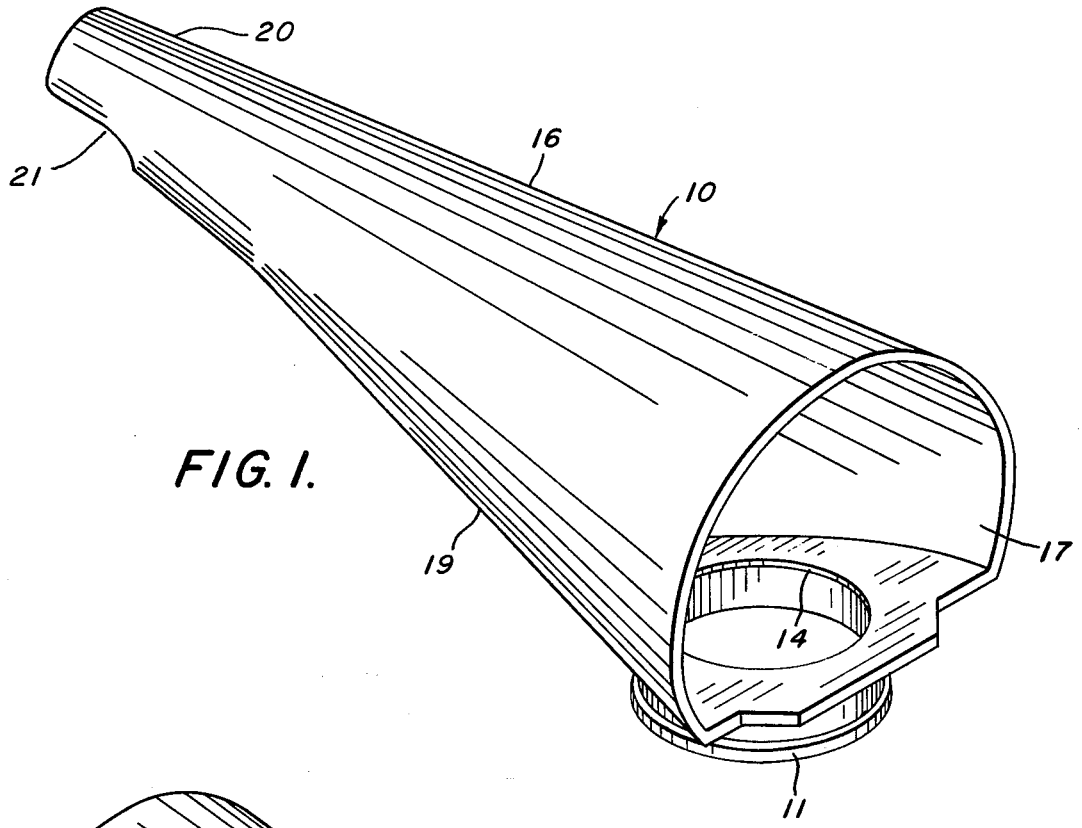
FIG. 1 is a rear perspective view of the pouring funnel of the invention.
Figure 2:
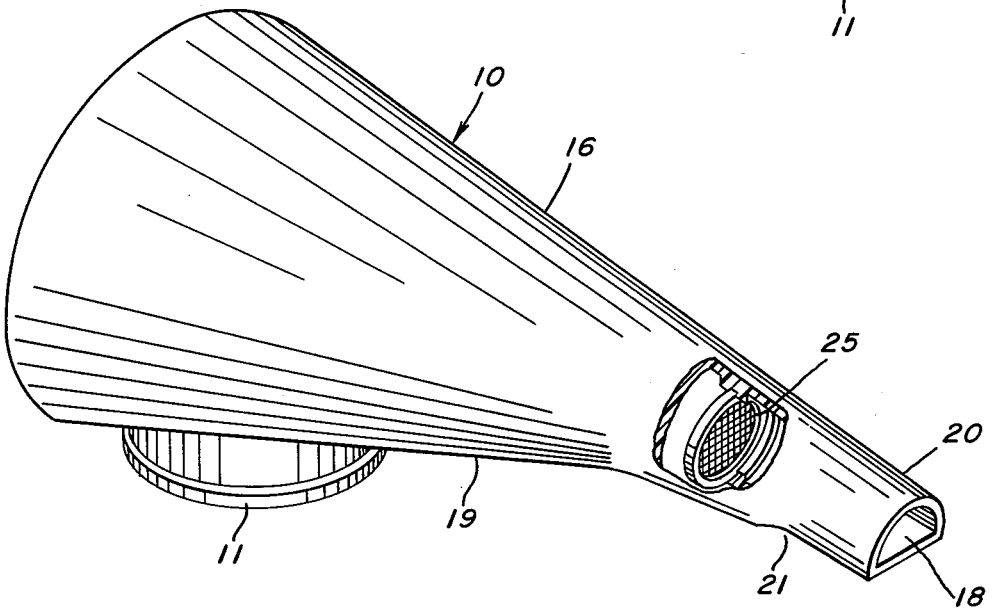
FIG. 2 is a front perspective view of the pouring funnel of the invention.

The funnel body 16 is open at both ends and tapers from a wide rear opening 17, proximate the collar portion 11, to a narrow outlet opening 18. The lower surface 19 of funnel body 16 tapers forwardly and upwardly from collar portion 11 to the outlet end 20. The outlet end 20 has a step 21 formed in its lower surface which defines outlet opening 18 as generally semi-cylindrical. A longitudinally extending rib 22 is integrally formed on the outer lower surface 19 of body portion 16, the rib 22 extending from collar portion 11 and terminating in a web portion 23 which projects into the step 21 formed in the lower surface of outlet end 20. The step 21 and web 23 serve as a bearing surface wherein the outlet end 20 may be rested on a receptacle (not shown), to which liquid is being transferred from the container 13. The rib 22 provides an air space between the funnel body 16 and the receptacle to which liquid is being transferred, to allow air to pass from the receptacle to permit smooth flow of liquid from the container 13 to the receptacle. The semi-cylindrical shape of the outlet opening 18 also serves to enhance smooth, laminar liquid flow and minimizes splashing and dripping. If desired, a conventional filter element 25 may be disposed within the funnel body 16 proximate the narrow outlet end 20, as shown in FIG. 2.

The wide rear opening 17 of funnel body 16 is also formed in a generally semi-cylindrical shape and is sized so as to permit substantially unobstructed manual access to the container spout 12 so as to allow removal or replacement of the container spout lid or cap 24. The cap 24 is illustrated as a conventional screw-type cap engaging threads formed on the container spout 12, but it is to be realized that other closure means for spout 12 may also be employed.

It should be noted that, due to the manner of engagement of the funnel 10 to the container spout 12, the funnel 10 may be rotated about spout 12 into different orientations with respect to container 13, as shown in phantom outline in FIG. 4, to facilitate the transfer of liquid from container 13 to a variety of receptacles that may be placed at out-of-the-way or inconvenient locations. It should also be noted that the funnel 10 may be conveniently left in place on the spout 12 and thereby not be readily misplaced.

Although the funnel construction of the invention has been described in considerable detail by the foregoing, it is to be understood that variations may be made by those skilled in the art without departing from the spirit, scope and essence thereof.

What is claimed is:

1. A detachable pouring funnel for use with a dome-top, liquid storage container having an upwardly projecting cylindrical spout, said spout provided with closure means and having an annular groove formed in the outer periphery thereof, said funnel comprising:

a body portion having a generally frusto-conical shape, the body portion being open at both ends and tapering from a wide rear opening to a narrow, generally cylindrical outlet end portion having an outlet opening;

a generally cylindrical collar portion integrally formed with and depending from the lower rear surface of the body portion and in open communication with the interior thereof, the longitudinal axis of the body portion extending laterally of the longitudinal axis of the collar portion, the collar portion sized to be snugly and removably received over the spout of the container, the upper edge of the collar portion formed as an inwardly directed annular flange which flange engages the annular groove formed in the outer periphery of the spout when the collar portion is press-fitted over the spout, the spout extending up through the collar portion and into the interior of the body portion, the size of the rear opening of the body portion being such as to permit substantially unobstructed manual access to the container spout to permit removal or replacement of the spout closure means when the funnel is in place.

2. The detachable pouring funnel of claim 1 wherein the lower surface of the funnel body tapers forwardly and upwardly from the collar portion to the outlet end.

3. The detachable pouring funnel of claim 2 wherein the outlet end has a step formed in the lower surface thereof, said step defining a generally semi-cylindrical shaped outlet opening.

4. The detachable pouring funnel of claim 3 wherein a longitudinally extending rib is integrally formed on the lower surface of the funnel body, said rib extending from the collar portion and terminating in a web portion which projects into the step formed on the lower surface of the outlet end.

5. The detachable pouring funnel of claim 1 wherein the rear opening of the funnel body has a generally semi-cylindrical shape.

6. The detachable pouring funnel of claim 1 wherein the collar portion and funnel body are integrally molded from a plastic material.

7. The detachable pouring funnel of claim 6 wherein the plastic material is a high density polyethylene.

8. The detachable pouring funnel of claim 1 having a filter element disposed in the outlet end.

* * * * *